United States Patent [19]

Ueki

[11] 3,962,049

[45] June 8, 1976

[54] PROCESS FOR COLORING ALUMINUM ANODIC OXIDE FILM

[75] Inventor: Shigeru Ueki, Kasukabe, Japan

[73] Assignee: Kabushiki Kaisha Aiden, Tokyo, Japan

[22] Filed: May 15, 1972

[21] Appl. No.: 253,430

[30] Foreign Application Priority Data

May 13, 1971 Japan ..... 46-31535

[52] U.S. Cl. ..... 204/35 N; 204/58

[51] Int. Cl.[2] ..... C25D 11/14; C25D 11/22; C25D 11/04

[58] Field of Search ..... 204/58, 56 R, 35 N

[56] References Cited

UNITED STATES PATENTS

| | | | |
|---|---|---|---|
| 3,382,160 | 5/1968 | Asada | 204/35 N |
| 3,635,802 | 1/1972 | Manning et al. | 204/56 R |
| 3,664,932 | 5/1972 | Patrie | 204/35 N |
| 3,666,638 | 5/1972 | Harris et al. | 204/35 N |
| 3,674,659 | 7/1972 | Livermore et al. | 204/56 R |

*Primary Examiner*—F.C. Edmundson

*Attorney, Agent, or Firm*—Haseltine, Lake & Waters

[57] ABSTRACT

An aluminum or aluminum alloy member is immersed in an acidic bath and is subjected to passage of an electrical current to form an anodic oxide film. The applied voltage is lowered either stepwise, linearly, or suddenly to a value in the range between about two-thirds and one one-hundredth, and the voltage is maintained at the lower value for a predetermined period of time, optionally with periodic interruption. The member with the thus formed anodic oxide film is then subjected to an electrolytic coloring treatment.

8 Claims, 10 Drawing Figures

ELECTRIC FILM THICKNESS (V)
BARRIER LAYER THICKNESS
12
10
8
6
4
2
0
168
140
112
84
56
28
0
1 2 3 4 5
TIME (min)

ELECTRIC FILM THICKNESS (V)
BARRIER LAYER THICKNESS
10
8
6
4
2
0
140
112
84
56
28
0
0.1 0.2 0.3 0.4 0.5
CURRENT DENSITY (A/dm²)

FORMATION ELECTRIC CURRENT DENSITY (A/dm²)
1.5
0.8
0.4
0.1
0
30 31 32 33
TIME (min.)

ELECTRIC CURRENT DENSITY (A/dm²)
+
−
0.2
0
3 8 11 16 19
90
TIME (sec.)

PROCESS FOR COLORING ALUMINUM ANODIC OXIDE FILM

BACKGROUND OF THE INVENTION

A. Field of the Invention

This invention relates to a process for the coloring of an aluminum anodic oxide film.

B. Prior Art

Coloring processes of the above type are known in which aluminum or aluminum alloy members are colored by an alternating current electrolysis process. In this conventional process, any desired density of color can be obtained by properly selecting the time of coloring, but the color density for a given period of coloring time varies in each and every coloring operation. This is caused by various conditions of the coloring operation itself, for example, change of liquid temperature, shape of the members, change of the composition of the coloring electrolyte, change of the aluminum ion amount in the bath, agitating conditions of the bath etc. However, this can be minimized if the control is fully effected but, the variation of color density is still produced even if these conditions are satisfied absolutely.

SUMMARY OF THE INVENTION

As a result of investigation, the inventor has found that the cause of variation of color density is related to the time when the aluminum anodic oxide film is formed.

Namely, formation of an anodic oxide film is usually effected by passing an electric current of a predetermined electric current density in an acidic bath using the aluminum or aluminum alloy member as the anode, but even if the electric current density is fixed at a predetermined value, it is so difficult to control the various conditions such as bath concentration, temperature, time, etc., and consequently, the voltage during the operation varies for every anodic oxide film formation operation. This means that for very anodic oxide film formation operation, the thickness of a barrier layer constituting an inner layer varies and accordingly, the color density is non-uniform according to the difference in barrier layer thickness. It has been also found that the barrier layer thickness varies, and accordingly, the color density becomes non-uniform especially according to the final voltage in the formation operation of the anodic oxide film.

An object of this invention is to provide a process based on this finding, by making the barrier layer produced in each anodic oxide film formation operation of a predetermined small thickness. Thereby, it becomes possible to avoid non-uniformity of color density by the subsequent electrolysis coloring step, and a product of predetermined color density is easily obtained.

The invention is characterized in that, from the time when an anodic oxide film is formed on an aluminum or aluminum alloy member, the formation voltage is lowered to a value between about two-thirds and one one-hundredth and after this lowered voltage is maintained for a predetermined time, the electric power supply is interrupted. Then the aluminum or aluminum alloy member with the anodic oxide film formed thereon is washed with water, and colored by electrolysis in a coloring electrolyte containing a metallic salt.

This invention will be explained in detail later with reference to several embodying examples.

These examples may be roughly classified into two categories. The first category is one in which the formation voltage is lowered in such a manner that the formation electric current which has been passed through an acidic bath for forming an anodic oxide film is lowered to a value between about two-thirds and one one-hundredth. This can be further divided into three subcategories.

1. A process in which the formation electric current is suddenly lowered and is maintained at the lowered value for a predetermined time. This is designated as a weak electrolysis treatment process.
2. A process in which the formation electric current is lowered stepwise and is maintained at the final value for a predetermined time. This is designated as a stepwise lowering treatment process.
3. A process in which the formation electric current is lowered in almost the same manner as in the case of the weak electrolysis treatment process but it is then passed intermittently. This is designated as an intermittent treatment process.

The second main category is directed to a process in which the formation voltage is gradually lowered to a value between two-thirds and one one-hundredth. This can be further divided into two subcategories.

4. A process in which the formation voltage is lowered gradually and linearly to a predetermined voltage and is then maintained at that value for a predetermined time. This is designated as a voltage linear lowering treatment process.
5. A process in which the formation voltage is lowered stepwise to a predetermined voltage and is then maintained at that value for a predetermined time. This is designated as a voltage stepwise lowering treatment process.

DETAILED DESCRIPTION

The treatment processes will now be described in detail as follows:

1. Weak electrolysis treatment process

Figure 1:
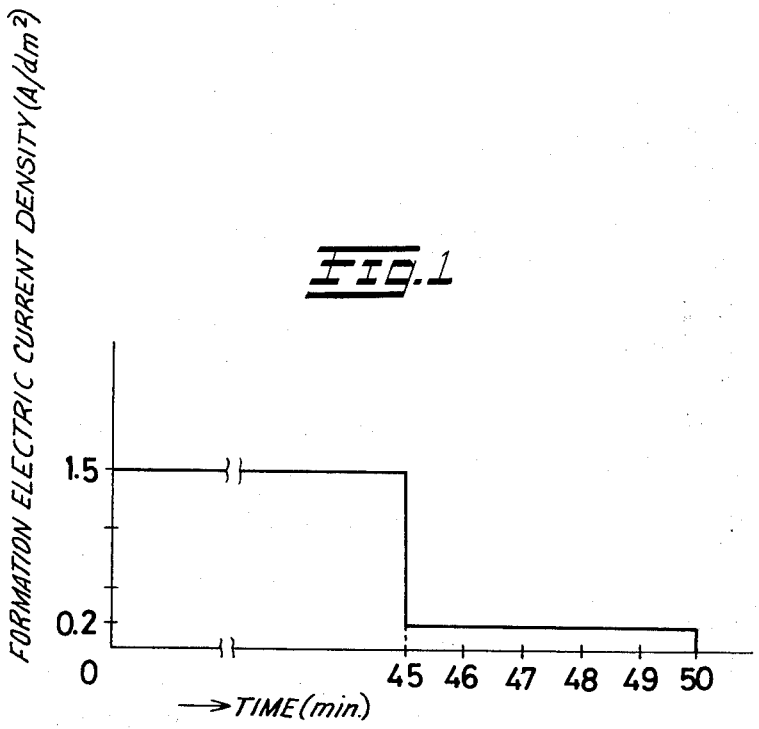
FIGS. 1 to 4 are graphical illustrations related to a weak electrolysis treatment process constituting one embodiment of this invention, FIG. 1 showing the relation between electric current and elapsed time, FIG. 2 the relation between voltage and elapsed time, FIG. 3 the relation between treating time and electric film thickness and FIG. 4 the relation between electric current density and final electric film thickness.

FIG. 1 shows the relation between electric current density and time of passage of the formation current in an anodic bath through an aluminum or aluminum alloy member, and in FIG. 1 is seen the condition that after an anodic oxide film is formed by passing electric current of 1.5 A/dm$^2$ for 45 minutes, the current density is suddenly lowered to 0.2 A/dm$^2$ and is then maintained at this value for a predetermined time, for example, for 5 minutes (weak electrolysis treatment) and then the power supply is cut.

Figure 2:
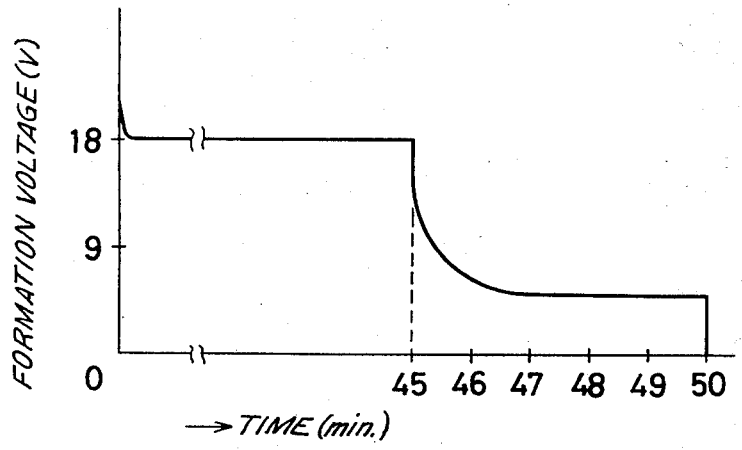

FIG. 2 shows the changing condition of the voltage during this operation and it is seen that from the moment when the current density has been lowered, the voltage is lowered along a quadric curve and after a lapse of about 2 minutes it remains at a predetermined level of about 5 volts.

Figure 3:
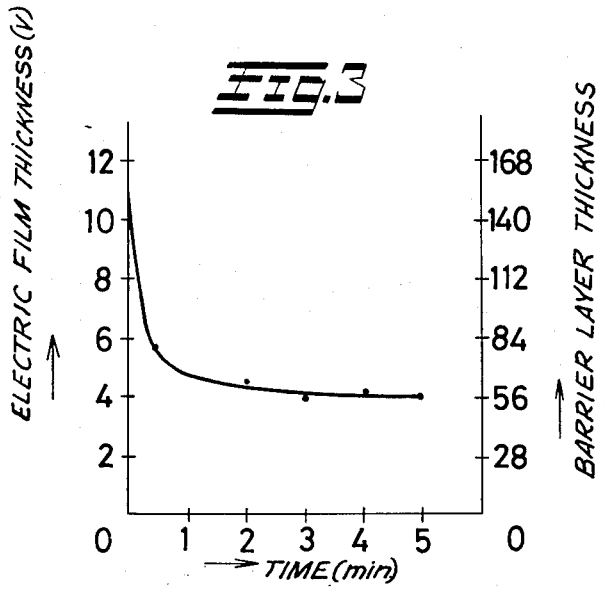

The thickness of the barrier layer produced at respective voltage levels along the descending quadric curve is measured by the Hunter-Fowle method to obtain the results as shown in FIG. 3. The Hunter-Fowle method is one in which it is first assumed that the property of the barrier layer is similar to that of a barrier type film formed by an aqueous solution (nearly neutral) of a borate, tartrate or the like, and it is also assumed that a barrier type film formed under a certain voltage is such that very small leakage electric current (about 150 $\mu$ A/cm$^2$, 3% ammonium tartrate PH 5.5) flows therethrough when the formation has been completed, the thickness of the film at that time being 14 A/V. Under those assumptions, a sample on which a porous type film is formed in a 15% (by weight) sulfuric acid (18 V, 90 sec.) is introduced into a 3% ammonium tartrate solution (PH 5.5) and then the voltage produced in the leakage electric current (for example 150 $\mu$ A/cm$^2$) passed at the previous formation voltage (18V) is read. This value is designated "electric film thickness" as represented by a voltage. The barrier layer thickness is calculated therefrom based on the fact that electric film thickness (V) multiplied by 14 A is nearly the thickness of the barrier layer thickness.

Figure 4:
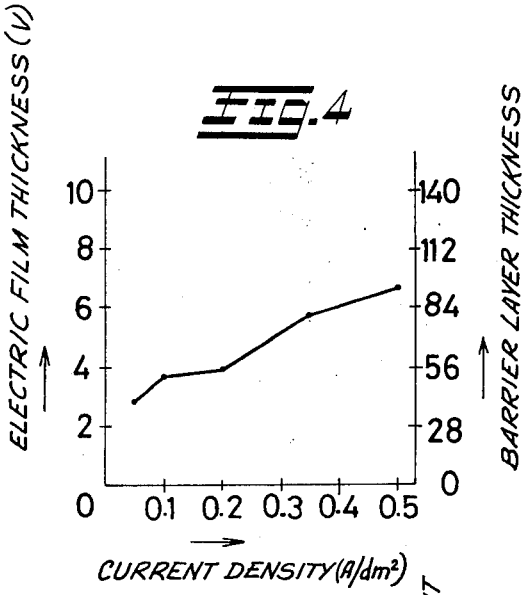

As is clear from FIG. 3, the electric film thickness becomes thinner as the final voltage is changed and a predetermined thickness of 4 V is maintained after a lapse of 3 minutes. At this time, the barrier layer thickness is 56 A. In the case when the formation current is lowered to 0.5 A/dm$^2$, 0.35 A/dm$^2$, 0.1 A/dm$^2$, 0.05 A/dm$^2$, the electric film thickness reaches a constant value after a lapse of about 30 sec., 40 sec., 3 minutes and 30 sec., and 5 minutes, respectively. FIG. 4 shows the relation between the final formation electric current density and the electric film thickness in the above examples.

It will be clear therefrom that any desired barrier layer thickness can be obtained depending on the value of the final electric current density lowered as above, that is, that of the final voltage, and the thickness thereof is very small in comparison with 178 A produced in the case when the formation electric current (about 1.5 A/dm$^2$) for forming of the anodic oxide film is cut off immediately after the completion of the film.

2. Stepwise lowering treatment process

In the stepwise lowering treatment process the formation electric current at the time of forming of an anodic oxide film is stepwise lowered and is maintained at each lowered step value for a predetermined time.

Figure 5:
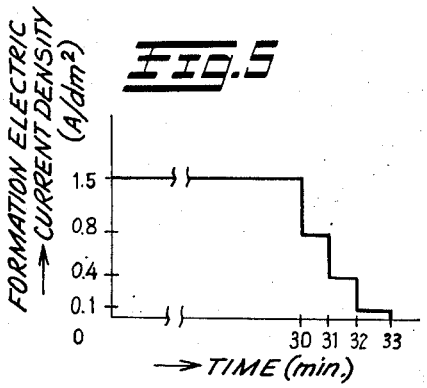
FIG. 5 is a graphical illustration of the changing condition of electric current in a stepwise lowering treatment process.

For example, as shown in FIG. 5, aluminum is subjected to a formation treatment for 45 minutes by passing a formation electric current of 1.5 A/dm$^2$ and this current is, then, lowered stepwise to 0.8 A/dm$^2$ (1 min.), 0.4 A/dm$^2$ (1 min.), and 0.1 A/dm$^2$ (1 min.). The electric film thickness becomes 2.2 V, and accordingly, the barrier layer thickness is 30.8 A.

3. Intermittent treatment process

Figure 6:
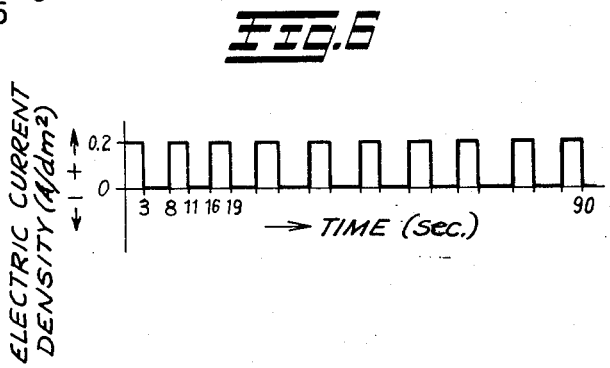
FIG. 6 is a graphical illustration showing the changing condition of electric current in an intermittent treatment process.

In this treatment process the electric current is intermittently passed at a predetermined electric density, lowered in the same manner as in the weak electrolysis treatment process. For example, as shown in FIG. 6, an electric current of 0.2 A/dm$^2$ is successively passed for 3 sec. and stopped for 5 sec. In this case, the voltage curve of quadric feature as shown in FIG. 2 is obtained in an intermittent manner. In this example, the voltage becomes constant after about 1 minute and 30 seconds, and the electric film thickness reaches 5.7 V which corresponds to a barrier layer thickness of 79.8 A. This electric film thickness is equal to a thickness 5.7 V of an electric film obtained in a weak electrolysis treatment process of 0.2 A/dm$^2$ for 35 sec., but it is colored thicker than that as described hereinafter.

Figure 7:
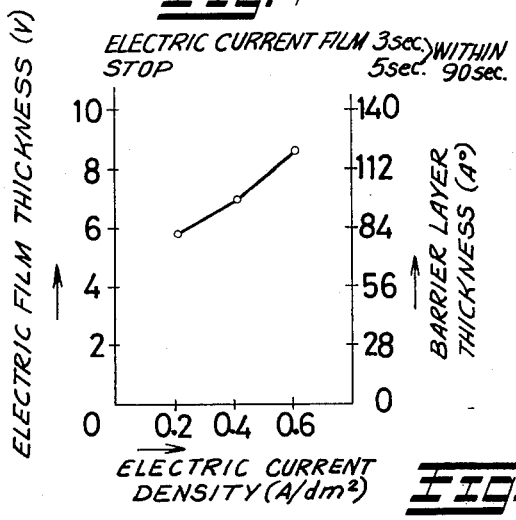
FIG. 7 is a graphical illustration showing the thickness of a barrier layer in the intermittent treatment process.

FIG. 7 shows the relation of electric film thickness with respect to the intermittent electric current value.

4. Electric voltage linear lowering treatment process

Figure 8:
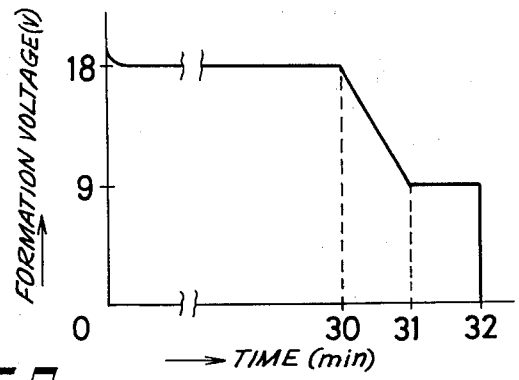
FIG. 8 is a graphical illustration showing the change of voltage in a linear voltage lowering process.

In this process the formation voltage is linearly lowered to a predetermined voltage and is maintained at that value for a predetermined time. FIG. 8 shows the condition in which the formation is effected with a formation voltage of 18 V for 30 minutes, whereafter the voltage is lowered linearly to 9 V in 1 minute and is maintained at 9 V for 1 minute. The electric film thickness in this case is 6.4 V corresponding to a barrier layer thickness of 90 A.

5. Electric voltage stepwise lowering treatment process

Figure 9:
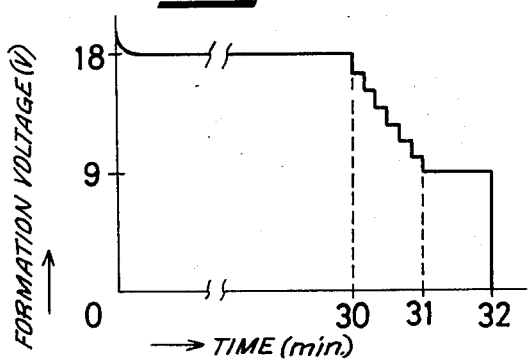
FIG. 9 is a graphical illustration showing the change of voltage in a voltage stepwise lowering treatment process.

In this process the formation voltage is lowered stepwise as shown in FIG. 9, by changeover of the taps of a transformer. Almost the same result is obtained in the voltage linear lowering treatment process. The electric film thickness is 6.5 V corresponding to a barrier layer thickness of 91 A.

Each of the above five treatment processes has been carried out in the same bath previously used for forming of the anodic oxide film, but the same result is obtained even when those processes are carried out in a separately prepared bath of the same composition.

The aluminum anodic oxide film obtained by any of these treatment processes is advantageous (as will be explained in connection with subsequent examples) not only because an intense color can be obtained in a short time but also because the color density is extremely uniform in every process and excellent products can be obtained.

Next, the relation between the above treatment processes (hereinafter called the intermediate treatment) and the color density will be described Samples of 2S aluminum of 50 mm × 100 mm × 0.5 mm were each subjected to a formation treatment for 30 minutes with an 11% (by volume) sulfuric acid solution, at a temperature of 20 ± 1°C, and an electric current density of 1.5 A/dm$^2$ to form an anodic oxide film thereon. Each sample was then subjected to each treatment as shown in the following table. Thereafter, in a coloring liquid of nickel sulfate 103 g/l, ammonium chloride 11 g/l, boric acid 33 g/l (PH 4.5 electric conductivity 27000 $\mu\Omega^{-1}$ $cm^{-1}$) and a temperature of 17°C. the sample was used as the cathode and for 4 minutes a direct current (three-phase full-wave rectification) of 0.5 A/dm² was passed for 3 seconds in succession with alternating current (sine wave) of 4.5 V which was passed for 8 seconds. Thereby there is obtained the results as shown in row f in Table 1, the enumerated intermediate treatments being given in rows a–c.

TABLE 1

| | Intermediate treatment | Treatment condition | Barrier layer thickness (A) | CIE three tristimulus values Color difference measuring Y | X | Z |
|---|---|---|---|---|---|---|
| a | Weak electrolysis treatment process | 0.05 A/dm² 5 min. | 39 | 3.40 | 3.80 | 3.30 |
| a' | | 0.2 A/dm² 3 min. | 56 | 4.42 | 4.86 | 4.16 |
| b | Stepwise lowering treatment process | 0.8 A/dm² 1 min. 0.4 A/dm² 1 min. 0.1 A/dm² 1 min. | 31 | 2.90 | 3.28 | 2.62 |
| c | Intermittent treatment process | 0.2 A/dm² current flow 3 sec. stop 5 sec. for 1 min. and 30 sec. | 80 | 2.32 | 2.62 | 2.20 |
| d | Voltage linear lowering treatment process | linear lowering 1 min. 9V 1 min. continued | 90 | 4.46 | 4.95 | 3.94 |
| e | Voltage stepwise lowering treatment process | Stepwise lowered 1 min. 9V (1 min.) | 91 | 4.76 | 5.30 | 4.24 |
| f | No treatment | | 178 | 6.74 | 7.40 | 6.20 |

Figure 10:
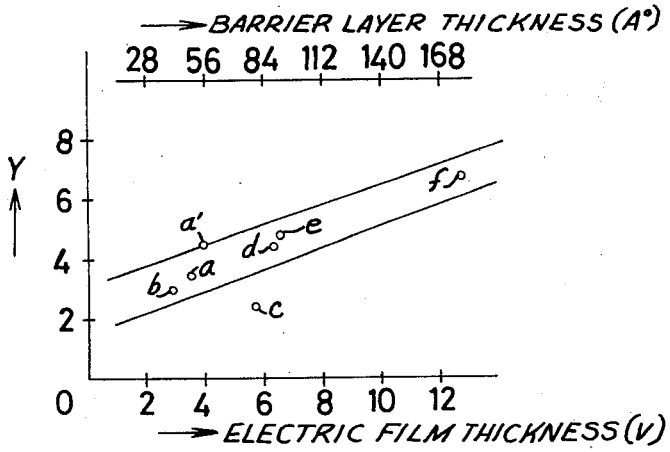
FIG. 10 is a graphical illustration showing the relation between barrier layer thickness and luminous reflectance value Y in each embodiment.

FIG. 10 shows the relation between the barrier layer thickness and the luminous reflectance value Y.

Here, the chromatic difference is neglected because the colored products are all of the same bronze color. As the lightness difference Δ El is a function of the luminous reflectance value Y, the comparison of Y becomes a criterion of color density. Accordingly, FIG. 10 is used for comparison purposes.

Next, non-uniformity is determined in the following way.

1. Weak electrolysis treatment process

Sixteen sheets of 99.5% aluminum plate (each being 50 mm × 100 mm × 0.5 mm) were prepared, and these were subjected in random order for 30 minutes each, to a formation electric current of 1.5 A/dm² in a 15% (by weight) sulfuric acid bath (20 ± 2°C.) hereinafter referred to as the A bath, to form thereon an anodic oxide film. After completion of the formation treatment, the formation electric current was suddenly lowered to 0.35 A/dm² and then the weak electrolysis treatment was carried out for 1 minute. Then, after being washed with water, each sheet was subjected for 4 minutes to a coloring treatment in an acidic bath containing metallic salts (an aqueous solution of nickel sulfate 30 g/l, stannous sulfate 15 g/l, sulfuric acid 5 g/l, cresol sulfonic acid 12 g/l, and ammonium chloride 8 g/l, hereinafter referred to as the B bath) the sheet being used as the cathode (the anode was nickel) a direct current of 0.5 A/dm² and an alternating current of 4.8 V being passed alternately in succession for 3 and 5 seconds, respectively.

2. Intermittent treatment process

Sixteen sheets of aluminum plate were prepared in almost the same manner as in the above weak electrolysis treatment process, and each plate was subjected to a formation treatment in the A bath and an intermittent treatment process of successive electric current flow of 0.2 A/dm² for 3 seconds and interruption for 5 seconds over a period of 1 minute. Thereafter a coloring treatment was effected in the B bath as before in process (1).

3. No intermediate treatment

Sixteen sheets of aluminum plate similar to those used in the foregoing process were prepared, and each plate was subjected to a formation treatment in the A bath and, after being washed with water, was subjected to coloring in the B bath with successive alternating current and direct current flows as before in processes (1) and (2).

After the colored aluminum plates obtained by the foregoing three processes were subjected to water washing and pore closing treatments, four plates are selected at random from each group and the three tristimulus values of X, Y, Z were measured by a color difference meter. A value of color difference Δ E was obtained therefrom by the Adams color difference formula.

$$\Delta E = 40 \{[\Delta(V_x - V_y)]^2 + [0.2^3 \Delta V_y]^2 + [0.4\Delta(V_z - V_y)]^2\}^{1/2}$$

Here, $V_x$, $V_y$, $V_z$ are Munsell value functions and are obtained from X, Y, Z by a conversion table. The unit of the color defference of Δ $E$ is the National Bureau of Standards Unit. The obtained values from the above are shown in Table 2 below.

TABLE 2

| | Weak electrolysis treatment process | Intermittent treatment process | Non-treatment |
|---|---|---|---|
| Sample 1 | 4.3 NBS | 10.4 NBS | 16.4 NBS |
| Sample 2 | 4.7 NBS | 9.3 NBS | 22.9 NBS |
| Sample 3 | 5.6 NBS | 8.2 NBS | 25.2 NBS |
| Sample 4 | 4.9 NBS | 9.9 NBS | 19.3 NBS |

Here, the color difference is obtained by comparing the colors with black of $X$=0.77, $Y$=0.88 and $Z$=0.82 selected as a standard. The colors are examined by "Significance Test of Equality of Two Population" (JIS Z 9056) as to whether there exists or not a difference in non-uniformity of color difference. It can be said the danger rate is 1% from the fact that the population in the case of weak electrolysis treatment process is smaller than that in the case of no treatment. Additionally, it can be said that the danger rate is 5% from the fact that the population in the case of intermittent treatment process is smaller than that in the case of no treatment.

EXAMPLE 2

One hundred sheets of 99.0% aluminum plate (each being 50 mm × 100 mm × 0.5 mm) were prepared.

1. Weak electrolysis treatment process

Twenty five sheets selected at random from the above were subjected to a formation treatment by a direct current of 1.5 A/dm² for 30 minutes in a 15% (by weight) sulfuric acid bath (hereinafter called C bath) to form an anodic oxide film thereon. Then, each plate was subjected to a weak electrolysis treatment process in which the electric current was suddenly lowered to 0.2 A/dm² and then maintained for 3 minutes. After being washed with water, the plate was used as the cathode (the anode being nickel) in an aqueous solution (22 ± 2 °C) comprising nickel sulfate 120 g/l, ammonium chloride 15 g/l and boric acid 30 g/l (hereinafter called the D bath) and successive flows of alternating current and direct current were passed to effect coloring. The D.C. was 0.5 A/dm² for 3 sec. and the A.C 5 V for 5 sec., these being alternately switched over a period of 4 minutes.

2. Stepwise lowering treatment process

Twenty five sheets selected at random were each similarly treated in the C bath so that an anodic oxide film was formed thereon, and then each sheet was subjected to a stepwise lowering treatment in which the electric current density was stepwise lowered to 0.8 A/dm² (1 min.), 0.4 A/dm² (1 min.) and 0.1 A/dm² (1 min.). The plates, after being washed with water, were subjected to an alternating current and a direct current coloring operation in the D bath under the same conditions as in the above process 1).

3. Voltage linear lowering treatment process

Twenty five sheets selected at random were each similarly treated in the C bath to form an anodic oxide film thereon, and then each sheet was subjected to an electric voltage linear lowering treatment process in which the voltage of about 18 V was linearly lowered to 9 V in 1 minute and then kept at this voltage for 1 minute. After being washed with water, the plates were subjected to successive alternating current and direct current flows to effect coloring under the same conditions in the D bath.

4. No intermediate treatment

The remaining 25 sheets were similarly treated in the C bath to form an anodic oxide film thereon, and then, without effecting any intermediate treatment, the plates were washed with water and subjected to successive alternating current and a direct current flows under the same conditions in the D bath.

After the products colored by the respective processes as mentioned above were subjected to a water washing and pore closing treatment, five sheets were respectively selected by a random sampling method from each group. These were measured by a color difference meter to obtain three tristimulus values X, Y, Z according to CIE and the color difference Δ E was obtain in the NBS unit by the Adams color difference formula. Here, black of X=0.77, Y=0.88, Z=0.82 was selected as the standard. The following results were obtained and are given in the following Table 3.

TABLE 3

| | Weak electro-treatment process | Stepwise lowering treatment process | Voltage linear lowering treatment process | No treat-ment |
|---|---|---|---|---|
| Sample 1 | 8.4 NBS | 7.6 NBS | 11.2 NBS | 25.6 NBS |
| Sample 2 | 8.4 NBS | 8.8 NBS | 11.2 NBS | 22.0 NBS |
| Sample 3 | 8.8 NBS | 8.4 NBS | 12.0 NBS | 26.4 NBS |
| Sample 4 | 8.0 NBS | 8.4 NBS | 11.6 NBS | 25.2 NBS |
| Sample 5 | 8.0 NBS | 8.4 NBS | 10.8 NBS | 28.8 NBS |

These values are examined by the "Significance Test of Equality Of Two Population" (JIS Z 9056) as to whether there exists or not a non-uniformity in color difference. As a result thereof, it can be said that the danger rate is 1% from the fact that the population in the electrolysis treatment process is smaller than that in the case of non-treatment. Additionally, it can be said that the danger ratio is 1% from the fact that the population by the stepwise lowering treatment process is smaller than that by no treatment and the population by the electric voltage straight lowering process is smaller than that by the no treatment process.

Thus, according to this invention, it is contemplated that from the time when an aluminum or aluminum alloy member has been treated in an acidic bath so as to form an anodic oxide, the voltage applied thereto is gradually lowered to a value in a range between about two-thirds and one one-hundredth and is kept at the final lowered voltage for a predetermined time. By properly selecting the final lowered electric voltage, and desired electric film thickness, that is, any desired thickness of barrier layer can be obtained. If the member is then subjected to a coloring treatment in a coloring electrolyte containing metallic salts, any desired color density corresponding to the barrier layer thickness can be obtained, and no non-uniformity of color is obtained due to the uniform barrier layer thickness.

What is claimed is:

1. A process for forming a colored anodic oxide film on a base member of aluminum or aluminum alloy, said process comprising applying electrical voltage to an aluminum or aluminum alloy member in an acidic bath at a determinable formation voltage for a pre-determined period of time to form an anodic aoxide film thereon with an inner barrier layer of a pre-determined thickness, reducing the thickness of the barrier layer to a particular value by lowering the voltage applied to said member over a period of 1 to 3 minutes to a value in a range between about two-thirds and one one-hundredth of the formation voltage and maintaining the voltage at the thus lowered value for an additional predetermined period of time of between 1 to 3 minutes after which the electric power supply is terminated, washing the member with water, and subjecting said member to electrolysis coloring in a coloring electrolyte containing metallic salts, the reduced thickness of the barrier layer to the particular value permitting the formation of a predetermined color density of substantial uniformity in the anodic oxide film.

2. A process as claimed in claim 1 wherein the voltage is lowered gradually and linearly to said lowered value.

3. A process as claimed in claim 1 wherein the voltage is lowered stepwise to said lowered value.

4. A process as claimed in claim 1 wherein the voltage is lowered in a manner to provide a sudden drop in current density from a value corresponding to the formation voltage to a value corresponding to said lowered value.

5. A process as claimed in claim 4 comprising intermittently interrupting the current flow after it has been lowered.

6. A process as claimed in claim 1 wherein the voltage is lowered in a manner to provide a stepwise drop in current density from a value corresponding to the formation voltage to a value corresponding to said lowered value.

7. A process as claimed in claim 1 wherein for an initial thickness of the inner barrier of 178A, the reduced thickness of the inner barrier layer 31 to 91A.

8. A process as claimed in claim 1 wherein the supply of reduced voltage is terminated after the inner barrier layer has reached its pre-determined thickness and continued application of voltage does not substantially affect said thickness.

* * * * *